US005133928A

United States Patent [19]

Oldfield

[11] Patent Number: 5,133,928

[45] Date of Patent: Jul. 28, 1992

[54] CYLINDER BODY OF A STEEL COMPOSITION

[75] Inventor: Frederick K. Oldfield, Chesterfield, England

[73] Assignee: Chesterfield Cylinders Limited, Chesterfield, England

[21] Appl. No.: 569,415

[22] Filed: Aug. 17, 1990

[30] Foreign Application Priority Data

Oct. 28, 1989 [GB] United Kingdom ..... 8924337
Jul. 25, 1990 [GB] United Kingdom ..... 9016285

[51] Int. Cl.[5] ..... C22C 38/22
[52] U.S. Cl. ..... 420/105; 420/108
[58] Field of Search ..... 148/334, 909; 420/105, 420/108

[56] References Cited

U.S. PATENT DOCUMENTS 4,394,189 7/1983 Greer ..... 148/12 R
4,741,880 5/1988 Lang et al. ..... 148/334

FOREIGN PATENT DOCUMENTS 1051886 10/1979 Fed. Rep. of Germany .
2445888 8/1980 France .
159971 9/1984 Japan ..... 420/105
694557 10/1979 U.S.S.R. ..... 148/334
1360483 7/1974 United Kingdom .

OTHER PUBLICATIONS

Stahlschüssel, Key to Steels, 1988, p. 117.

*Primary Examiner*—Deborah Yee
*Attorney, Agent, or Firm*—Gifford, Groh, Sprinkle, Patmore & Anderson

[57] ABSTRACT

A steel composition is especially suitable for pressure vessels and comprises carbon (0.32–0.37%), silicon (0.15–0.35%), manganese (0.60–0.90%), chromium (0.80–1.10%), molybdenum (0.35–0.55%), aluminum (0.01–0.05%), phosphorus up to a maximum of 0.02%, sulphur up to a maximum of 0.005% and nickel up to a maximum of 0.25%. The composition gives enhanced strength and toughness for the purpose using straightforward heat treatment methods.

4 Claims, 1 Drawing Sheet

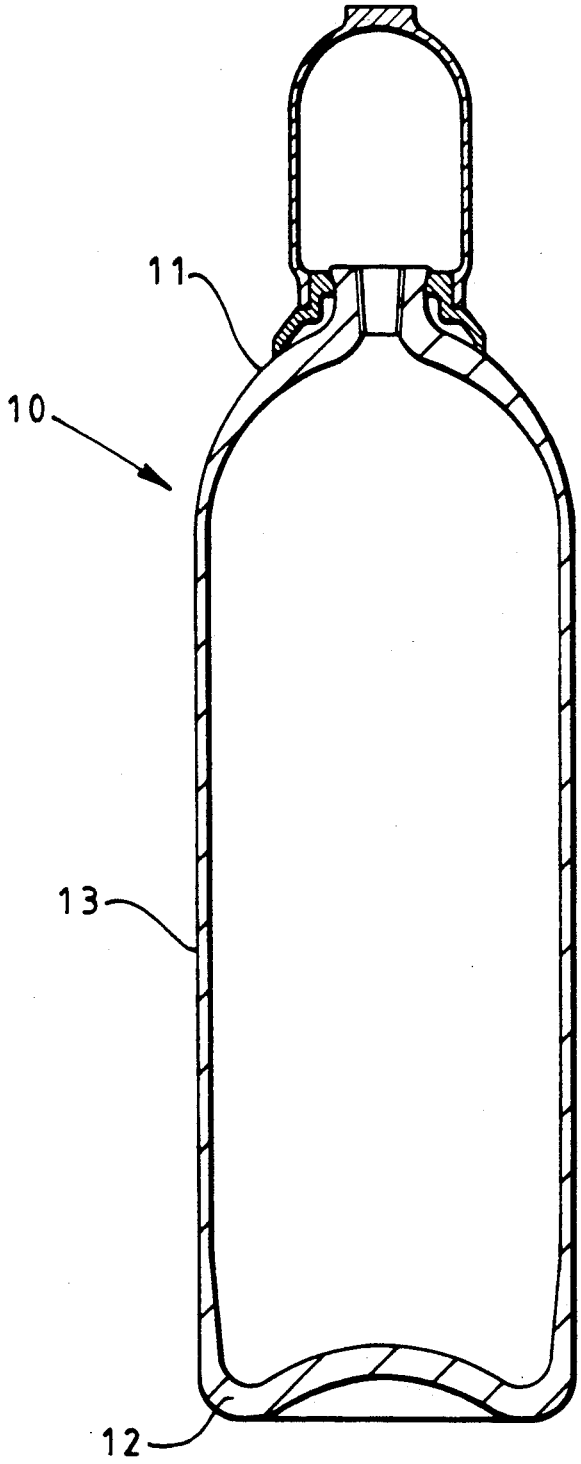
11
10
13
12

CYLINDER BODY OF A STEEL COMPOSITION

This invention relates to steel compositions and in particular steel composition especially suitable for pressure vessels such as cylinders for containing gas under pressure, i.e. gas storage cylinders.

Gas storage cylinders have conventionally been made from steel to have a capacity in the range 1 litre to 150 litres and service pressures of up to 300 bar or higher.

Safety in service under the high pressures and energy of the gas in storage cylinders is of prime consideration and attention is given to the material used in such cylinders as well as the design of the cylinders, manufacturing techniques, testing and use.

Gas cylinders have a weight many times greater than the weight of the contents when full and considerable advantages would accrue if the weight of the cylinder for a given capacity could be reduced. However, this requires that cylinders with thinner walls would be required and the walls would have greater levels of stress. To maintain the necessary safety margins the yield strength and tensile strength of the material would have to increase in proportion to the increase in wall stress.

Conventionally, chromium/molybdenum alloy steels have been used for seamless gas storage cylinders having typically about 1% by weight chromium and about 0.25% molybdenum. One example of such a steel is the steel code "CM" found in British standards BS 5045 Part 1, 1982. Such a steel has a tensile strength limited to about 1100 N/mm$^2$ or less. The steel is capable of achieving higher strengths by selective heat treatment but with a resultant loss of toughness and ductility. By toughness is meant the ability of the material to resist fracture in the presence of stress concentrations which may result from small manufacturing defects or service induced damage. Toughness is a fundamental property of gas cylinders because of the potentially explosive energy of the compressed gas therein.

It has been proposed, for example in U.S. Pat. No. 4461657, to produce a higher strength steel compared with conventional steels by adding vanadium to the composition in the 0.04%-0.10% by weight range together with calcium or rare earth elements.

An object of this invention is to provide a steel composition which is capable of being heat treated to consistently attain the desired properties.

According to the invention a steel composition for use in pressure vessels comprises;

Carbon: from 0.32 to 0.37% by weight
Silicon: from 0.15 to 0.35 by weight
Manganese: from 0.60 to 0.90% by weight
Chromium: from 0.80 to 1.10% by weight
Molybdenum: from 0.35 to 0.55% by weight
Phosphorus: a maximum of 0.02% by weight
Sulphur: a maximum of 0.005% by weight
Aluminum: from 0.01 to 0.05% by weight
Nickel: a maximum of 0.25% by weight By an increase in the amount of molybdenum and a reduction in the quantity of sulphur compared with existing compositions it has been found to be possible, using the appropriate heat treatment, to achieve the desired strength, toughness and ductility required for gas storage cylinders when the wall stress of the cylinders is increased.

The steel may be heat treated to impart the desired properties in a three stage process. Firstly the steel is austenised and the heated steel is immediately quenched. The steel is then tempered.

Austenitizing may be carried out for twenty minutes at a temperature in the range 870°-920° C. The quenching medium may be mineral oil or other suitable liquid providing the desired cooling rate. Tempering may be carried out for thirty minutes at a temperature in the range 580°-630° C., the actual temperature used depending on the actual steel compositions within the ranges referred to above and the desired mechanical properties required.

It has been found that a steel composition within the ranges specified and heat treated as described may achieve tensile strengths of the gas storage cylinder of up to 1250 N/mm$^2$ with commensurate values of yield strength toughness and ductility for the gas storage application referred to.

Preferably the steel composition comprises:

Carbon: from 0.32%-0.36% by weight
Silicon: from 0.15-0.35 by weight
Manganese: from 0.60%-0.90% by weight
Chromium: from 0.80%-1.10% by weight
Molybdenum: from 0.40%-0.50% by weight
Phosphorus: a maximum of 0.01 by weight
Sulphur: a maximum of 0.005% by weight
Aluminum: from 0.010%-0.050% by weight
Nickel: a maximum of 0.25% by weight The properties of the composition may be further enhanced by a further reduction in sulphur content to less than 0.003% by weight.

Preferably the quenching temperature is in the range 880°-900° C. and tempering is conducted at a minimum temperature of 570° C. For such a composition, heat treated as indicated, the expected tensile strength should be in the range 1069-1260 N/mm$^2$ with a yield strength exceeding 960 N/mm$^2$.

The steel composition may be made by the electric arc or basic oxygen process and oil quenched and tempered. Compositions with such low sulphur contents are generally obtained by secondary steelmaking processes by which steel from a furnace is passed for subsequent metallurgical processes to a secondary unit, such as a ladle furnace. The steel is tapped from the primary furnace through a submerged taphole to avoid slag carry-over. In the secondary furnace or vessel the steel may be desulphurised to low sulphur levels as required in the present composition. Alloying and removal of oxidation products can also take place using inert gas to avoid the presence of oxygen.

EXAMPLE

In one example of a steel composition according to the invention the composition comprised:

Carbon: 0.36% by weight
Silicon: 0.27% by weight
Manganese: 0.69% by weight
Chromium: 1.03% by weight
Molybdenum: 0.46% by weight
Phosphorus: 0.006% by weight
Sulphur: 0.002% by weight
Aluminum: 0.028% by weight
Nickel: 0.11% by weight Quenching was conducted at 880° C. in mineral oil and tempering was carried out at 580° C. The tensile strength of such steel was found to be 1100 N/mm$^2$ and the yield strength was 1000 N/mm$^2$.

The steel composition of the example can be used in a gas cylinder of the kind shown in the accompanying drawing which shows a vertical cross section through a cylinder.

The drawing shows a seamless gas container 10 of generally cylindrical form having an upper outlet end 11 and a bottom end 12. The outlet end is generally hemispherical and concave to pressure with increased wall thickness compared with the side wall 13, and the bottom end 12 is convex to pressure and also with increased wall thickness compared with side wall 13.

The outlet end 11 carries the inlet and outlet connections (not shown) whereby the container is filled and discharged.

The container is formed by hot drawing and has an integral bottom 12 formed by backward extrusion and drawing. The outlet end is formed by hot spinning.

By forming the container illustrated using the steel composition of the invention the storage capacity of the container can be significantly increased compared with existing steel compositions. Thus the working pressure can be at or somewhat greater than 300 bar while still giving the necessary safety factor. By increasing capacity a significant improvement in the costs of transportation and storage can be achieved. At the same time heat treatment requirements for the steel are still within the usual capabilities for making such storage containers.

I claim:

1. In a gas cylinder a cylinder body of a steel composition comprising by weight:

carbon: 0.32%–0.37%
silicon: 0.15%–0.35%
manganese: 0.60%–0.90%
chromium: 0.80%–1.10%
phosphorus: less than 0.02%
aluminum: 0.01%–0.05%
nickel: 0.35%–0.55%
molybdenum: 0.35%–0.55%
sulfur: less than 0.005% and the balance being iron and incidental impurities.

2. The cylinder body according to claim 1 wherein said sulphur content is less than 0.003%.

3. The cylinder body according to claim 1 wherein said molybdenum content is in the range 0.40%–0.50%.

4. The cylinder body according to claim 1 wherein the steel is heat treated by quenching at a temperature in the range 870°–920 ° C. and tempering is carried out in the range 570°–630° C.

* * * * *